US010648480B2

(12) United States Patent
Echeverri

(10) Patent No.: US 10,648,480 B2
(45) Date of Patent: May 12, 2020

(54) LOW INLET VORTICITY IMPELLER HAVING ENHANCED HYDRODYNAMIC WEAR CHARACTERISTICS

(71) Applicant: FLSmidth A/S, Valby (DK)

(72) Inventor: Luis Fernando Echeverri, Tuscon, AZ (US)

(73) Assignee: FLSmidth A/S

( * ) Notice: Subject to any disclaimer, the term of this patent is extended or adjusted under 35 U.S.C. 154(b) by 0 days.

(21) Appl. No.: 16/091,961

(22) PCT Filed: Apr. 6, 2017

(86) PCT No.: PCT/IB2017/051978

§ 371 (c)(1),
(2) Date: Oct. 5, 2018

(87) PCT Pub. No.: WO2017/175165

PCT Pub. Date: Oct. 12, 2017

(65) Prior Publication Data

US 2019/0120242 A1 Apr. 25, 2019

Related U.S. Application Data

(60) Provisional application No. 62/319,010, filed on Apr. 6, 2016.

(51) Int. Cl.
*F04D 29/22* (2006.01)
*F04D 7/04* (2006.01)
(Continued)

(52) U.S. Cl.
CPC ..... *F04D 29/2294* (2013.01); *F04D 7/04* (2013.01); *F04D 29/245* (2013.01); *F04D 29/688* (2013.01)

(58) Field of Classification Search
CPC ..... F04D 29/2294; F04D 29/688; F04D 7/04; F04D 29/245; F04D 29/242
See application file for complete search history.

(56) References Cited

U.S. PATENT DOCUMENTS 5,478,200 A 12/1995 Brodersen et al.

FOREIGN PATENT DOCUMENTS

EP 2410186 A1 1/2012
GB 1412488 A * 11/1975 ..... F04D 7/04

OTHER PUBLICATIONS

The Favorable International Search Report and Written Opinion dated Jul. 5, 2017, 12 pages.

(Continued)

*Primary Examiner* — Christopher Verdier
(74) *Attorney, Agent, or Firm* — Jeffrey A. Sharp

(57) ABSTRACT

Provided are non-limiting embodiments of a wear-resistant impeller having a non-conventional blending provided between a surface of a vane (1) and a surface of at least one of a front side shroud (15) and a rear side shroud (16). The impeller may comprise both a rear side blending (3) and a front side blending (2), and the front side blending (2) may comprise a different geometry from the rear side blending (3). The blending preferably comprises a bulbous geometry which is uniquely adapted for optimizing flow patterns adjacent to the vane and between the front and rear side shrouds in a manner which discourages the formation of horseshoe vortices proximate the leading edge (6) of the vane (1) during operation. Through the reduction, mitigation, or elimination of horseshoe vortices, local high velocities and turbulence are generally minimized, and wear experienced by portions of the impeller (e.g., to one or more vanes) from flows of abrasive slurry can be reduced. Accordingly, the useable life of an impeller may be improved.

20 Claims, 8 Drawing Sheets

(51) Int. Cl.
*F04D 29/24* (2006.01)
*F04D 29/68* (2006.01)

(56) References Cited

OTHER PUBLICATIONS

The International Application published Oct. 12, 2017.
The International Preliminary Examination Report dated Jul. 19, 2018.

* cited by examiner

| Angles | Range | Preferred values |
|---|---|---|
| B1 | 30 - 90 deg. | 40 - 60 deg. |
| B2 | 30 - 90 deg. | 50 - 70 deg. |

| WIDTH | Range | Preferred values |
|---|---|---|
| w1 / t | 0.7 - 1.1 | 0.8 - 1 |
| w2 / t | 0.55 - 0.95 | 0.7 - 0.8 |
| w3 / t | 0.9 - 1.6 | 1.1 - 1.4 |
| w4 / t | 0.5 - 1.1 | 0.55 - 0.65 |
| w5 / t | 0.5 - 1.1 | 0.6 - 0.8 |
| w6 / t | 0.05 - 0.95 | 0.1 - 0.2 |
| w7 / t | 0.95 - 2 | 1.25 - 1.75 |

| WIDTH | Range | Preferred values |
|---|---|---|
| w1 / Rs | 0.145 - 0.23 | 0.165 - 0.21 |
| w2 / Rs | 0.115 - 0.195 | 0.145 - 0.165 |
| w3 / Rs | 0.185 - 0.33 | 0.23 - 0.29 |
| w4 / Rs | 0.105 - 0.23 | 0.115 - 0.135 |
| w5 / Rs | 0.105 - 0.23 | 0.125 - 0.165 |
| w6 / Rs | 0.01 - 0.195 | 0.02 - 0.04 |
| w7 / Rs | 0.195 - 0.415 | 0.26 - 0.365 |

| HEIGHT | Range | Preferred values |
|---|---|---|
| Hf / H | 0.1 - 0.4 | 0.15 - 0.25 |
| Hr / H | 0.1 - 0.4 | 0.25 - 0.35 |

| RADIUS | Range | Preferred values |
|---|---|---|
| Rf / Rs | 1.2 - 2.5 | 1.4 - 1.6 |
| Rr / Rs | 1.2 - 2.5 | 1.3 - 1.4 |

FIGURE 21

| Angles | Range | Preferred values |
|---|---|---|
| B1 | 30 - 90 deg. | 50 - 70 deg. |
| B2 | 30 - 90 deg. | 60 - 80 deg. |

| WIDTH | Range | Preferred values |
|---|---|---|
| w1 / t | 0.6 - 1.1 | 0.7 - 1 |
| w2 / t | 0.55 - 1.05 | 0.7 - 0.9 |
| w3 / t | 0.9 - 2.1 | 1.2 - 1.8 |
| w4 / t | 0.5 - 1.1 | 0.7 - 0.9 |
| w5 / t | 0.5 - 1.1 | 0.6 - 0.85 |
| w6 / t | 0.05 - 0.95 | 0.05 - 0.2 |
| w7 / t | 0.95 - 2 | 1.25 - 1.75 |

| WIDTH | Range | Preferred values |
|---|---|---|
| w1 / Rs | 0.125 - 0.23 | 0.15 - 0.22 |
| w2 / Rs | 0.115 - 0.22 | 0.15 - 0.2 |
| w3 / Rs | 0.185 - 0.435 | 0.25 - 0.35 |
| w4 / Rs | 0.105 - 0.23 | 0.145 - 0.2 |
| w5 / Rs | 0.105 - 0.23 | 0.12 - 0.18 |
| w6 / Rs | 0.01 - 0.195 | 0.01 - 0.04 |
| w7 / Rs | 0.195 - 0.415 | 0.26 - 0.36 |

| HEIGHT | Range | Preferred values |
|---|---|---|
| Hf / H | 0.1 - 0.4 | 0.15 - 0.25 |
| Hr / H | 0.1 - 0.4 | 0.25 - 0.35 |

| RADIUS | Range | Preferred values |
|---|---|---|
| Rf / Rs | 1.2 - 2.5 | 1.4 - 1.9 |
| Rr / Rs | 1.2 - 2.5 | 1.3 - 1.8 |

FIGURE 22

LOW INLET VORTICITY IMPELLER HAVING ENHANCED HYDRODYNAMIC WEAR CHARACTERISTICS

CROSS-REFERENCE TO RELATED APPLICATIONS

This application claims the benefit of U.S. Provisional Patent Application Ser. No. 62/319,010 filed on 6 Apr. 2016 and titled "Low Inlet Vorticity Impeller Having Enhanced Hydrodynamic Wear Characteristics". This application is a § 371 National Stage Entry Application of PCT/IB2017/051978. The aforementioned applications are hereby incorporated by reference in their entirety for any and/or all purposes as if fully set forth herein.

FIELD OF THE INVENTION

This application pertains to pumps, impellers for pumps, vane designs for reducing wear in pumps, and methods of manufacturing impellers for pumps. In particular, this application pertains to novel centrifugal pumps for industrial uses, including slurry conveying purposes (i.e., slurry pumps).

Particularly disclosed, is a centrifugal pump impeller design which incorporates a vane ( ) provided with at least one unique blending geometry specially tailored to optimize flows, resist wear, and improve impeller longevity.

BACKGROUND OF THE INVENTION

Pumps adequately configured for improved longevity are needed to reduce operational expenditures (OPEX) in industrial operations. By increasing the practical runtime of pumps (between scheduled maintenance and overhaul cycles), operators can run their processes longer with less downtime, with less spare parts equipment purchases, and/or with less maintenance/labor costs. Unlike prior designs, embodiments of the improved impeller and robust wear-resistant vane design disclosed herein (e.g., shown in FIGS. 2, 4, 6, 8-21) have been shown to extend practical wear life and run time by at least 50% as compared with the conventional designs shown in FIGS. 1, 3, 5, and 7. One example of a conventional centrifugal pump can be seen in U.S. Pat. No. 5,478,200.

A need exists for such pump impellers which can be readily manufactured without substantial increases in cost, and which demonstrate superb wear characteristics that result in increased runtime before overhaul. The subject matter disclosed herein at least partially satisfies this need and provides a plethora of advantages as will be appreciated by those versed in the pump arts.

SUMMARY OF THE INVENTION

An impeller for a centrifugal pump is disclosed. The impeller comprises a vane (1) extending in a Z-direction between an annular front side shroud (15) and a rear side shroud (16). The vane (1) comprises a radially inward leading edge (6), a radially outward trailing edge (7), a convex side (4), and a concave side (5). The vane (1) is connected to the front side shroud (15) and to the rear side shroud (16). An inventive characteristic of the impeller is that it further comprises at least one of a front side blending (2) and a rear side blending (3).

The front side blending (2) may be provided between a surface of the vane (1) and a surface of at the front side shroud (15) as shown. The rear side blending (3) may be provided between a surface of the vane (1), and a surface of the rear side shroud (16) as shown. Each blending is preferably provided proximate to and extends from the leading edge (6) of the vane (1). Each blending is also preferably configured with a bulbous geometry (i.e., a non-uniform protrusion comprising a three-dimensional compound curve surface) which geometrically differs from a conventional (i.e. uniform) radius fillet (8) having radius (r). Each blending may protrude from the vane (1), preferably with its own unique geometry. The bulbous geometry of each blending is preferably adapted to optimize flow patterns adjacent to the vane (1) and between the front (15) and rear (16) side shrouds in a manner which discourages the formation of horseshoe vortices proximate the leading edge (6) of the vane (1) during operation. By virtue of discouraging the formation of horseshoe vortices proximate the leading edge (6) of the vane (1) during operation, the front and rear side blendings (3) are more suitably adapted to mitigate the effects of wear to the impeller from abrasive slurry during operation. Accordingly, the front (2) and rear (3) side blendings may substantially extend the life of the impeller as compared to conventional impellers (which only comprise a conventional radius (r) fillet (8) between a surface of a vane (1) and a surface of a front (15) and rear (16) side shroud as shown in FIGS. 1, 3, and 5).

Each blending is preferably provided proximate the leading edge (6) of the vane (1) and proximate to a central region of the impeller, for example, proximate radially inside portions of the front (15) and rear (16) side shrouds, without limitation. In most preferred embodiments, the vane (1) comprises both front and rear side blendings (3) near its leading edge (6), with a front side blending (2) being provided proximate to a central region of the front side shroud (15), and a rear side blending (3) being provided proximate to a central region of the rear side shroud (16).

In some embodiments, a conventional radius fillet may be provided between a surface of the vane (1) and a surface of at least one of the front side shroud (15) and the rear side shroud (16), in addition to the blending(s). For example, if a front side blending (2) is provided to a vane (1), a front side conventional radius fillet (10) having radius (r) may be provided adjacent to the front side blending (2) as shown. Moreover, if a rear side blending (3) is provided to a vane (1), a rear side conventional radius fillet (9) having radius (r) may be provided adjacent to the rear side blending (3) as shown. Front side (10) and/or rear side (9) conventional radius fillets may be provided proximate the trailing edge (7) of the vane (1), as well as proximate to portions of concave and convex sides (4) of the vane (1). Each blending may be provided proximate the leading edge (6) of the vane (1) and may transition to a respective conventional radius fillet at two points (e.g., points p1 and p4 for FIG. 4; or points s1 and s6 for FIG. 6) where the blending terminates, without limitation.

In some embodiments, the impeller may comprise both a front side blending (2) (e.g., provided between a surface of the vane (1) and a surface of the front side shroud (15)), and a rear side blending (3) (e.g., provided between a surface of the vane (1) and a surface of the rear side shroud (16)). The front side blending (2) and the rear side blending (3) may each be provided adjacent the leading edge (6) of the vane (1). The front side blending (2) and the rear side blending (3) may each be configured with a bulbous geometry which geometrically differs from a conventional radius (r) fillet (8). Preferably, the bulbous geometry of each of the front (2) and rear (3) side blendings is adapted to optimize flow patterns adjacent to the vane (1) and between the front (15) and rear (16) side shrouds in a manner which discourages the formation of horseshoe vortices proximate the leading edge (6) of the vane (1) during operation.

In some preferred embodiments, the front side blending (2) may geometrically differ from both the rear side blending (3) and its respective front side conventional radius fillet (10), and the rear side blending (3) may geometrically differ from both the front side blending (2) and its respective rear side conventional radius fillet (9). However, it is envisaged and contemplated that less desirable embodiments of an impeller according to the invention could instead incorporate symmetrical, mirrored, similar, or identical front- and rear-side blending geometries or portions thereof, and still achieve some measurable benefit. For preferred embodiments, the relative dimensions of blendings may be selected from any of the preferred values shown in FIGS. 21 and 22, in any combination or permutation, without departing from the scope of the invention. The entire contents of the tables shown in FIGS. 21 and 22 are incorporated by reference herein, as if described in this description with text and prose and as if each and every possible permutation that could be derived therefrom was described herein. The Applicant reserves the right to incorporate any specific value, range of values, or combination or permutation of values shown in FIGS. 21 and 22, into the claims of this application, or into the claims of a continuing application thereof.

In some embodiments, the rear side blending (3) may extend from a first point (p1) of the convex side (4) along the vane's perimeter, circumferentially around the leading edge (6) of the vane (1), to a second point (p4) of the concave side (5) along the vane's perimeter. In some embodiments, a width of the rear side blending (3) may increase from a first width (w1) near the first point (p1), to a larger third width (w3) near the second point (p4) as the rear side blending (3) progresses circumferentially along the vane's perimeter and peripherally around the leading edge (6). The rear side blending (3) may further comprise a transitional second width (w2) between the first width (w1) and the third width (w3) at a point along the vane's perimeter which is circumferentially disposed between the first point (p1) and the second point (p4). The leading edge (6) may be substantially encompassed between the first point (p1) and the second point (p4) when viewed along said Z-direction (i.e., in a plane which is perpendicular to said Z-direction).

In some embodiments, the transitional second width (w2) of the rear side blending (3) may be larger than the first width (w1) and smaller than the third width (w3). The rear side blending (3) may transition to a rear conventional radius fillet (9) at an angle (B1), at the second point (p4) of the concave side (5). The angle (B1) may be measured about an axis defining the Z-direction (13) and may approximate the angular separation between the leading edge (6) and the second point (p4) of the rear side blending (3). The rear side blending (3) may transition to a rear side conventional radius fillet (9) at the first point (p1) of the convex side (4). It should be understood, however, that not all embodiments will necessarily comprise a conventional radius fillet; and that some less-preferred embodiments could instead comprise sharp intersections (i.e., no-fillets) between the vanes and two shrouds (15, 16), without limitation. As illustrated in FIG. 4, the first point (p1) may be oriented at a lesser angle than the angle (B1), with respect to a polar origin defined by the intersection of the X-direction (12), Y-direction (11), and Z-direction (13).

In some embodiments, the second point (p4) of the rear side blending (3) may be located closer to the trailing edge (7) of the vane (1) than the first point (p1) of the rear side blending (3). For example, the second point (p4) of the rear side blending (3) may be located closer to the trailing edge (7) of the vane (1) than the first point (p1) of the rear side blending (3) in at least a Y-direction (11) (i.e., which is perpendicular to the Z-direction (13)), and/or the second point (p4) of the rear side blending (3) may be located closer to the trailing edge (7) of the vane (1) than the first point (p1) of the rear side blending in at least an X-direction (12) (i.e., which is perpendicular to both the Z-direction (13) and the Y-direction (11)), without limitation. The rear side blending (3) may comprise one or more inflection points (p2, p3) provided between the first point (p1) of the rear side blending (3) and the second point (p4) of the rear side blending (3) along the vane's perimeter, without limitation.

The first inflection point (p2) of the rear side blending (3) may lie between the first point (p1) of the rear side blending (3) and the second inflection point (p3) of the rear side blending (3). The second inflection point (p3) of the rear side blending (3) may lie between the first inflection point (p2) of the rear side blending (3) and the second point (p4) of the rear side blending (3). A portion of the rear side blending (3) extending between the first point (p1) of the rear side blending (3) and the first inflection point (p2) of the rear side blending (3) may be concave; a portion of the rear side blending (3) extending between the first inflection point (p2) of the rear side blending (3) and the second inflection point (p3) of the rear side blending (3) may be convex; and a portion of the rear side blending (3) extending between the second inflection point (p3) of the rear side blending (3) and the second point (p4) of the rear side blending (3) may be concave, without limitation.

A front side blending (2) may extend from a first point (s1) of the convex side (4) along the vane's perimeter, circumferentially around the leading edge (6) of the vane (1), to a second point (s6) of the concave side (5) along the vane's perimeter. A width of the front side blending (2) may increase from a first width (w4) near the first point (s1), to a larger fourth width (w7) near the second point (s6) as the front side blending (2) progresses circumferentially along the vane's perimeter and peripherally around the leading edge (6). The front side blending (2) may further comprise a transitional second width (w5) between the first width (w4) and the fourth width (w7) at a point along the vane's perimeter which is circumferentially disposed between the first point (s1) and the second point (s6). The leading edge (6) may be substantially encompassed between the first point (s1) and the second point (s6) when viewed along said Z-direction in a plane which is perpendicular to said Z-direction.

In some embodiments, the transitional second width (w5) of the front side blending (2) may be equal to or larger than the first width (w4) and smaller than the fourth width (w7), without limitation. In some embodiments, the front side blending (2) may decrease from a first width (w4) near the first point (s1), to a transitional third width (w6), before widening to the fourth width (w7), without limitation. In some embodiments, the front side blending (2) may begin at a first point (s1) on a convex side (4) of the vane (1) where a front side conventional radius fillet (10) having a radius (r) ends. The front side blending (2) may widen to a first width (w4), subsequently widen to a larger transitional second width (w5), subsequently shrink to a smaller transitional third width (w6), and then subsequently widen again to a fourth width (w7), before ending at a second point (s6) on a concave side (5) of the vane (1), where the front side conventional radius fillet (10) begins. The fourth width (w7)

may be greater than the transitional second width (w5); the transitional second width (w5) may be greater than the first width (w4); and the first width (w4) may be greater than the transitional third width (w6), without limitation. As shown, the transitional third width (w6) of the front side blending (2) may be the smallest of the first width (w4), second width (w5), and fourth width (w7).

In some embodiments, the front side blending (2) may decrease from a first width (w4) near the first point (s1), to a transitional third width (w6), before widening to the fourth width (w7). As shown in the figures, the front side blending (2) may comprise one or more inflection points (s2, s3, s4, s5) provided between the first point (s1) of the front side blending (2) and the second point (s6) of the front side blending (2) along the vane's perimeter. The inflection points may be representative of changes from convex to concave curvatures of surfaces extending circumferentially along the vane's perimeter. The front side blending (2) may comprise a larger width (w7) adjacent the fourth point (s4), and smaller width (w4) adjacent the first point (s1).

In some embodiments, the inventive impeller disclosed may comprise a front side conventional radius fillet (10) extending from a first point (s1) on the convex side (4) of the vane (1), circumferentially along the vane's perimeter to a fourth point (s4) on the concave side (5) of the vane (1). The front conventional radius fillet (10) may extend around the trailing edge (7) of the vane, wherein the front side blending (2) may initially grow in width from the first point (s1), then shrink to its smallest width (w6), and then grow to its largest width (w7), before returning to the fourth point (s4). The front side blending (2) may extend only partially, or completely around the leading edge (6) of the vane (1) (as shown), without limitation. In some less desirable embodiments (not shown), portions of a blending may be gradually less apparent or non-existent on a convex side (4) and/or on a concave side (5) of a vane (1), wherein a blending may be concentrated proximate the leading edge (6) of the vane (1), without limitation. In some embodiments, a blending may reduce in width (and/or effective perimeter) along the Z-direction (13), when approaching a chord line through the center of the vane (1), or a blending may increase in width (and/or effective perimeter) along the Z-direction (13), when approaching a chord line through the center of the vane (1), without limitation.

In some embodiments, the front side blending (2) may comprise a first inflection point (s2) between the first point (s1) and the second point (s6). In some embodiments, the front side blending (2) may comprise a second inflection point (s3) between the first point (s1) and the second point (s6). In some embodiments, the front side blending (2) may comprise a third inflection point (s4) between the first point (s1) and the second point (s6), without limitation. The front side blending may comprise a fourth inflection point (s4) between the first point (s1) and the second point (s6); the front side blending may transition to a front side conventional radius fillet (10) at an angle (B2), at the second point (s6); and the angle (B2) may be greater than the angle (B1), without limitation. As with the rear side blending (3), the first point (s1) of the front side blending may, in some embodiments, be positioned relative to a polar origin at an angle which is less than the angle (B2) shown for the second point (s6) of the front side blending.

As shown, a portion of the front side blending extending between the first point (s1) of the front side blending and the first inflection point (s2) of the front side blending may be concave; a portion of the front side blending extending between the first inflection point (s2) of the front side blending and the second inflection point (s3) of the front side blending may be convex; wherein a portion of the front side blending extending between the second inflection point (s3) of the front side blending and the third inflection point (s4) of the front side blending may be concave; a portion of the front side blending extending between the third inflection point (s4) of the front side blending and the fourth inflection point (s5) of the front side blending may be convex; and a portion of the front side blending extending between the fourth inflection point (s5) of the front side blending and the second point (s6) of the front side blending may be concave, without limitation.

In some embodiments, the second point (s6) of the front side blending may be located closer to the trailing edge (7) of the vane (1) than the first point (s1) of the front side blending. For example, the second point (s6) of the front side blending may be located closer to the trailing edge (7) of the vane (1) than the first point (s1) of the front side blending in at least a Y-direction (11) (i.e., which is perpendicular to the Z-direction (13)), and/or the second point (s6) of the front side blending may be located closer to the trailing edge (7) of the vane (1) than the first point (s1) of the front side blending in at least an X-direction (12) (i.e., which is perpendicular to both the Z-direction (13) and the Y-direction (11)), without limitation.

A method for increasing the life of a centrifugal pump is further disclosed. The method may comprise the steps of: providing an impeller according to any one of the preceding embodiments described above; running slurry through the centrifugal pump while the impeller is turning; and, by virtue of vane (1) design characteristics of the impeller (e.g., the bulbous geometry of at least one blending which differs from a conventional radius fillet (8)), optimizing flows to discourage the formation of horseshoe vortices and to resist wear to the impeller during operation of the centrifugal pump. The method may further include altering flow patterns adjacent to the vane (1) and between the front (15) and rear (16) side shrouds in a manner which improves impeller longevity and wear life.

BRIEF DESCRIPTION OF THE DRAWINGS

To complement the description which is being made, and for the purpose of aiding to better understand the features of the invention, a set of drawings illustrating new impeller apparatus is attached to the present specification as an integral part thereof, in which the following has been depicted with an illustrative and non-limiting character. It should be understood that like reference numbers used in the drawings (if any are used) may identify like components.

FIG. 3 shows an impeller vane (1) profile on a rear side shroud (16). FIG. 5 shows an impeller vane (1) profile on a front side shroud (15).

FIG. 4 shows an impeller vane profile on a rear side shroud (16). FIG. 6 shows an impeller vane profile on a front side shroud (15).

FIG. 21 shows a table suggesting that the geometry of vane (1) profiles for embodiments of the inventive impeller may be described in terms of the radius (Rs) of the suction inlet orifice (14), the thickness (t) of the pumping vanes at leading edge (6), the widths of the geometrical arcuate blending at the leading edge (6) disclosed herein (w1 to w7), and angles (B1, B2). The table further discloses corresponding geometrical ratios according to some preferred, but non-limiting embodiments to complement broader envisaged geometrical ranges.

FIG. 22 is another table suggesting preferred embodiments of a low vorticity vane (1) geometry that is within the inventive scope.

In the following, the invention will be described in more detail with reference to drawings in conjunction with exemplary embodiments.

DETAILED DESCRIPTION OF THE INVENTION

While the present invention has been described herein using exemplary embodiments of a pump impeller vane (1) showing preferred geometrical design ratios, it should be understood that numerous variations and adaptations will be apparent to those of ordinary skill in the field from the teachings provided herein. The detailed embodiments shown and described in the text and figures should not be construed as limiting in scope; rather, all provided embodiments should be considered to be exemplary in nature. Accordingly, this invention is only limited by the following claims.

A low vorticity vane inlet impeller configured for use within pumps is disclosed. The vane inlet impeller may be used in, for example, centrifugal pumps, without limitation. The impeller may, for example, be advantageously employed within a slurry pump, without limitation. As shown, the low vorticity vane inlet impeller incorporates at least one large scale custom-shaped arcuate blending along at least one leading edge (6) root and/or along the perimeter of the vane (1), where the vane (1) adjoins supporting front side (15) and/or rear side (16) shrouds. The at least one blending preferably extends to the stagnation line in the front of the vane (1), thereby promoting a smooth hydraulic transition or flow entrance into the impeller. By virtue of its inventive unique design, and the inventive geometry of the blending(s), the low vorticity vane inlet impeller is adequately configured to control or prevent the generation of horseshoe vortices and turbulence. The design of each blending is tailored to counter the erosive effects of flows thereby improving wear life of the pump impeller when handling liquid-solid mixtures or slurries.

Figure 1:
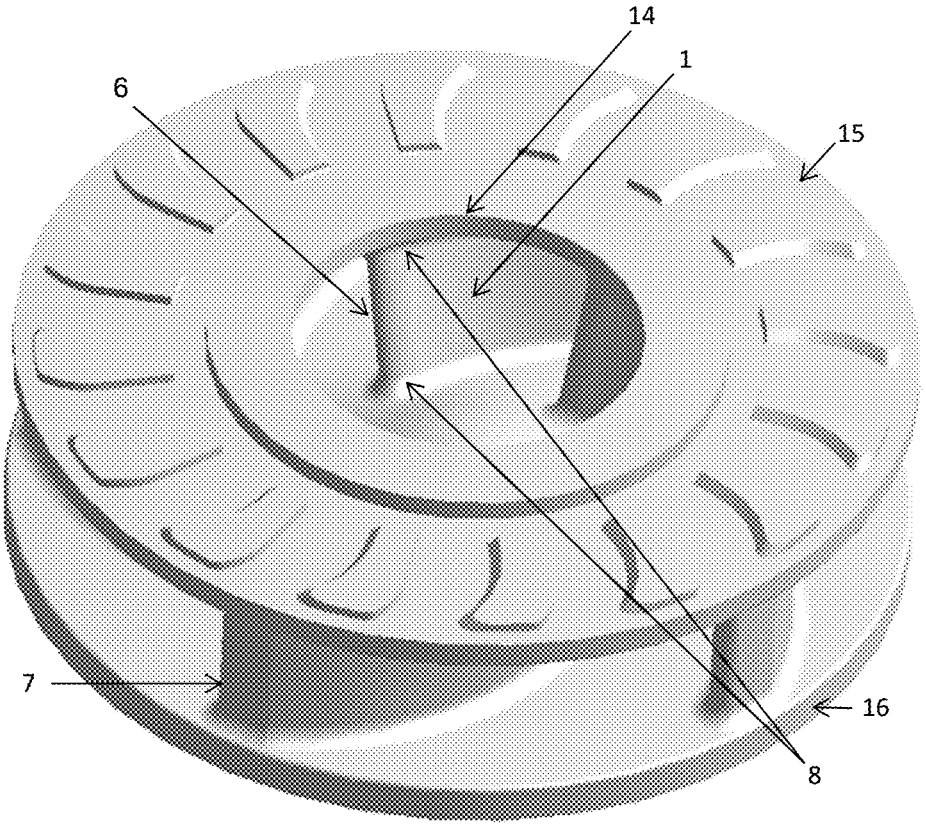
FIGURE 1 (Prior Art)
FIG. 1 shows a perspective rendering of an impeller (according to the prior art) which uses a standard or conventional (i.e., uniform) radius fillet (8) which provides a small radius (r) transition between vane (1) surfaces and surfaces of front (15) and rear (16) side shrouds.
Figure 2:
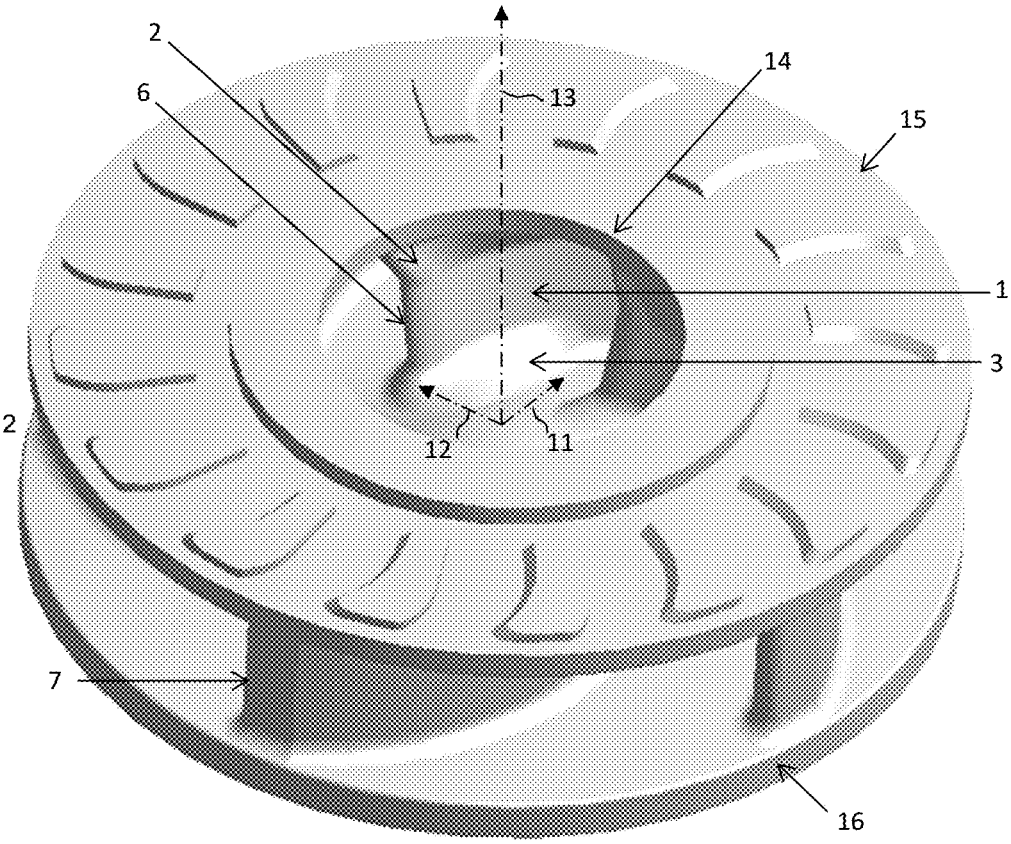
FIG. 2 shows a perspective rendering of an impeller (according to some embodiments of the invention) which employs front side- and rear side-blendings, wherein the blendings may comprise bulbous geometries. Each blending may be represented as a non-uniform protrusion comprising a three-dimensional compound curve surface as shown. Each of the front side and rear side blendings (3) may comprise unique bulbous geometries comprising both convex and/or concave protrusions, and both bulbous geometries may differ from each other. These non-standard blendings (provided adjacent leading edge (6) portions of vanes (1)), in optional combination with downstream radiused transitions (i.e., conventional radius fillets (9, 10) extending between vane (1) surfaces and surfaces of front (15) and rear (16) side shrouds, such as adjacent to trailing edge (7) portions of vanes), can modify fluid flow patterns in ways that can substantially reduce wear to the impeller. It is believed that by virtue of the unique geometrical design of the front side-(2) and/or rear side-(3) blendings, local high velocities and turbulence can be minimized, and horseshoe vortices can be tamed or substantially eliminated, without limitation.

FIGS. 1 and 2 identify the suction inlet orifice (14) and the front and rear side shrouds of an impeller. FIG. 1 shows a conventional impeller design of the prior art, and FIG. 2 shows an inventive embodiment according to the invention. FIGS. 3-6 identify additional language normally used to describe structural features of impeller pumping vanes, particularly in terms of a "leading edge", a "trailing edge", and ", concave" and "convex" sides.

Centrifugal pump impellers typically comprise pumping vanes that are universally abutted to front (15) and rear (16) side shrouds, defining a contact area with a perimeter normally provided with relatively small-scale concave fillets when compared with other dimensions of the impeller. In most cases, the small-scale concave fillets can be described with a conventional (i.e., uniform) radius fillet (8) having a radius (r) that displays a uniform value around the entire perimeter as shown in FIGS. 1, 3, 5 and 7. Embodiments of the invention introduce one or more large scale variably-sized arcuate blendings that are preferably noticeably enlarged towards the leading edge (6) of the vane (1). The one or more blendings preferably reduce progressively to match a normal concave fillet size towards the trailing edge (7) of the vane (1) as illustrated in FIGS. 2, 4, 6, and 8. In the particular embodiment shown in the figures, two blendings are provided to a single vane (1)—a front side blending (2) adjacent a front side shroud (15), and a rear side blending (3) adjacent a rear side shroud (16). It should be appreciated that less preferred embodiments may incorporate only a single blending (e.g., either a front side blending adjacent the front side shroud (15), or a rear side blending (3) adjacent the rear side shroud (16)). As will be stated hereinafter, the front side blending appears to have the most benefit. The combination of the proposed rear side blending (3) with the proposed front side blending appears to exhibit a greater synergistic effect.

Figure 3:
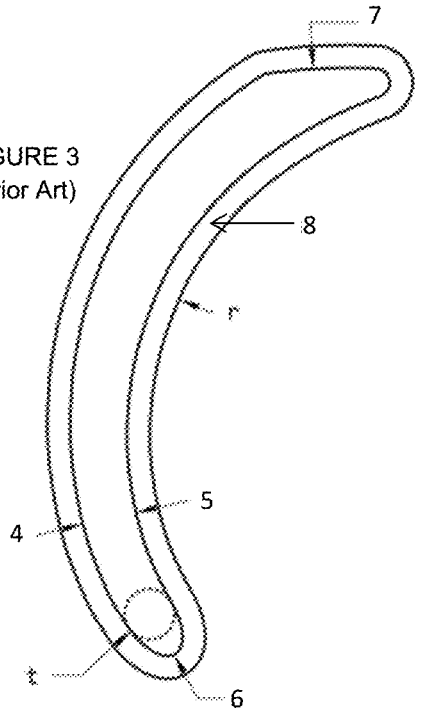
FIGURE 3 (Prior Art)
FIGS. 3, 5, and 7 illustrate upper and lower vane-to-shroud transitions for the prior art conventional impeller device shown in FIG. 1. In particular.
Figure 5:
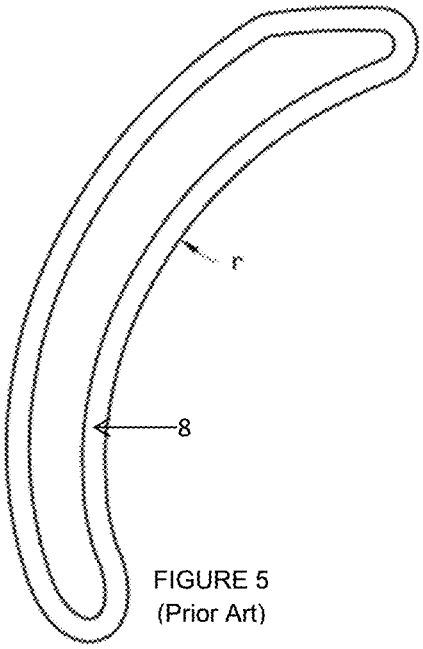
FIGURE 5 (Prior Art)

FIGS. 3 and 5 represent prior art figures each showing respective rear side and front side sectional views of a conventional pumping vane. As may be observed from FIGS. 3 and 5, profiles at the front and rear sides of a conventional vane are typically provided with a filleted transition to respective front and rear side shrouds (15, 16). Each fillet transition is concave and displays a uniform radius (r); wherein the radius (r) is generally relatively small in comparison with other main dimensions of the impeller. This may further be appreciated by FIG. 7, which shows a side profile suggesting the same conventional radius and fillet transitions from vane to both front side and rear side shrouds (15, 16).

Figure 4:
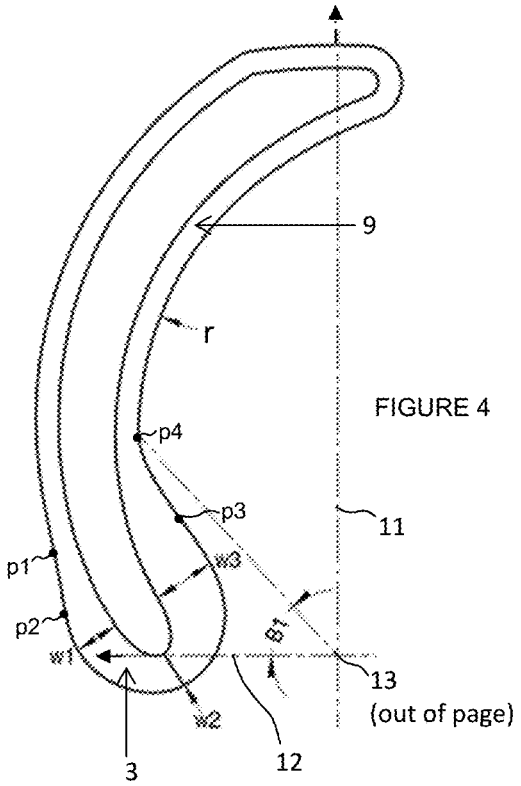
FIGS. 4, 6, and 8 illustrate upper and lower vane-to-shroud transitions for the inventive impeller device according to the embodiment shown in FIG. 2. In particular.
Figure 6:
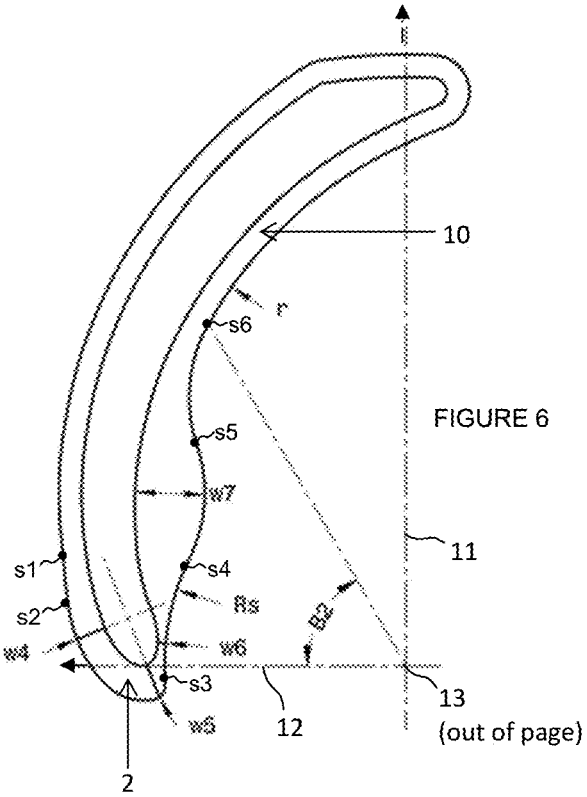

FIGS. 4 and 6 represent respective rear side and front side impeller pumping vane profiles according to some embodiments. As shown, trailing edge (7) of the vane (1) may comprise a conventional radius fillet (9, 10) transition having a relatively small radius (r) when compared with other main dimensions of the impeller. However, at portions of a vane (1) adjacent the leading edge (6), front and rear sides of the impeller may be provided with the larger scale arcuate blendings disclosed herein. The large-scale front side and rear side arcuate blendings are clearly distinguishable along the perimeter of the vanes towards the leading edge (6) due to their larger scale. The blendings may, as shown, progressively decrease in size towards the trailing edge (7) of the vanes.

Hydraulic studies applying numerical simulation suggested that for portions of a vane around or adjacent to the leading edge (6) of said vane (1), the concave side is more susceptible to vorticity erosive effects, and therefore the prescribed arcuate blendings may be preferably more pronounced or otherwise designed with larger dimensions and/or smoother transitions on the concave side (5) than on the convex side (4), without limitation, as suggested by FIGS. 4 and 6.

Portions of the vanes adjacent the rear side shroud (16) preferably abut a rear side shroud (16) surface that is continuous, in order to make it possible to design large scale rounded blendings surrounding the leading edges of the vanes as illustrated in FIG. 4.

Portions of the vanes adjacent the front side shroud (15) preferably abut on a front surface with discontinuity created by the impeller suction inlet orifice (14) (FIG. 1), with the leading edge (6) being adjacent to this discontinuity. As a result, the design of a large scale arcuate blending may, as illustrated in FIG. 6, be more intricate, and/or may require a specially-designed custom shape. For example, a large scale arcuate blending may be more intricate where concave and convex blending sections are combined, in order to make it possible to introduce such a large-scale blending within the relatively small space available between the leading edge (6) of the vanes and the suction inlet orifice (14).

The geometry of the vane (1) profiles is described in terms of the radius (Rs) of the suction inlet orifice (14), the thickness (t) of the pumping vanes at leading edge (6), the radius (r) of a small-scale concave fillet (9, 10) along the perimeter of the vanes, the widths of the geometrical arcuate blendings at the leading edge (6) disclosed herein (w1 to w7), and angles (B1, B2). Some anticipated corresponding geometrical ratios according to certain envisaged embodiments are disclosed in the tables shown in FIGS. 21 and 22. These geometries may be stated in reference to an X-direction (12), a Y-direction (11), and a Z-direction (13) which are perpendicular to each other and have axes which intersect at an origin.

Figure 7:
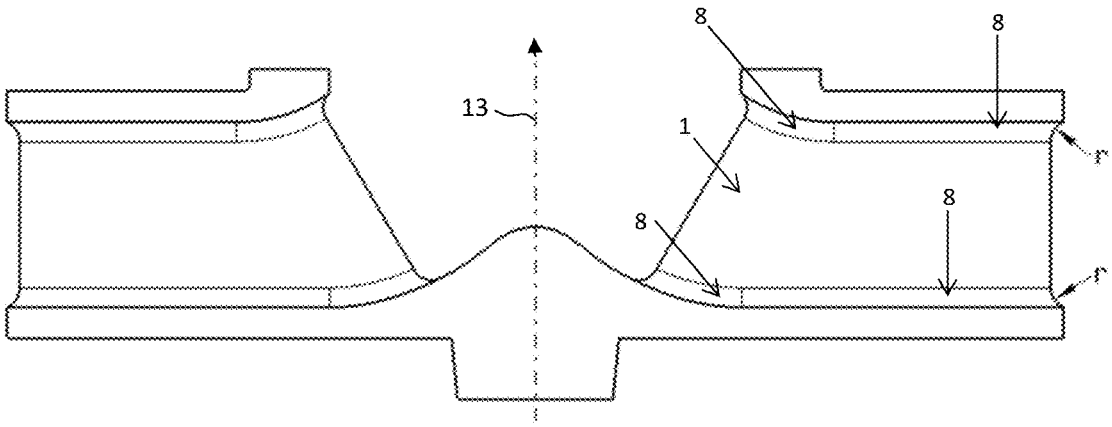
FIGURE 7 (Prior Art)

FIG. 7 presents a cross sectional view of a prior art conventional impeller illustrating a typical small-scale concave fillet (8) with uniform radius (r) along the periphery of the roots of the pumping vanes on the front and the rear sides of the impeller.

Figure 8:
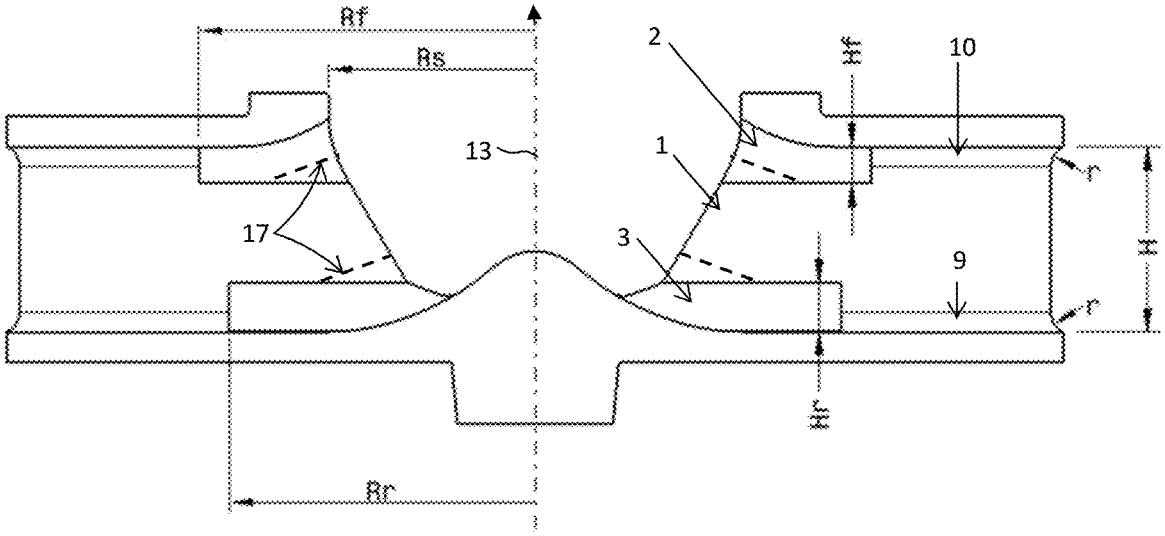

FIG. 8 presents a cross sectional view of an impeller provided according to some embodiments of the invention described herein. The shown impeller is clearly distinguishable around the leading edge (6) on the front and the rear sides of the impeller from what is currently known in the art. The geometry is described in terms of the width of the impeller (H), the width of the large scale arcuate blending on the front side (Hf) and the rear side (Hr), the radius (Rs) of the suction inlet orifice (14), and the distance from the impeller centreline the end of the blending feature at the front (Rf) and rear sides (Rr). Some corresponding geometrical ratios according to certain non-limiting embodiments are disclosed in the tables shown in FIGS. 21 and 22.

Figure 9:
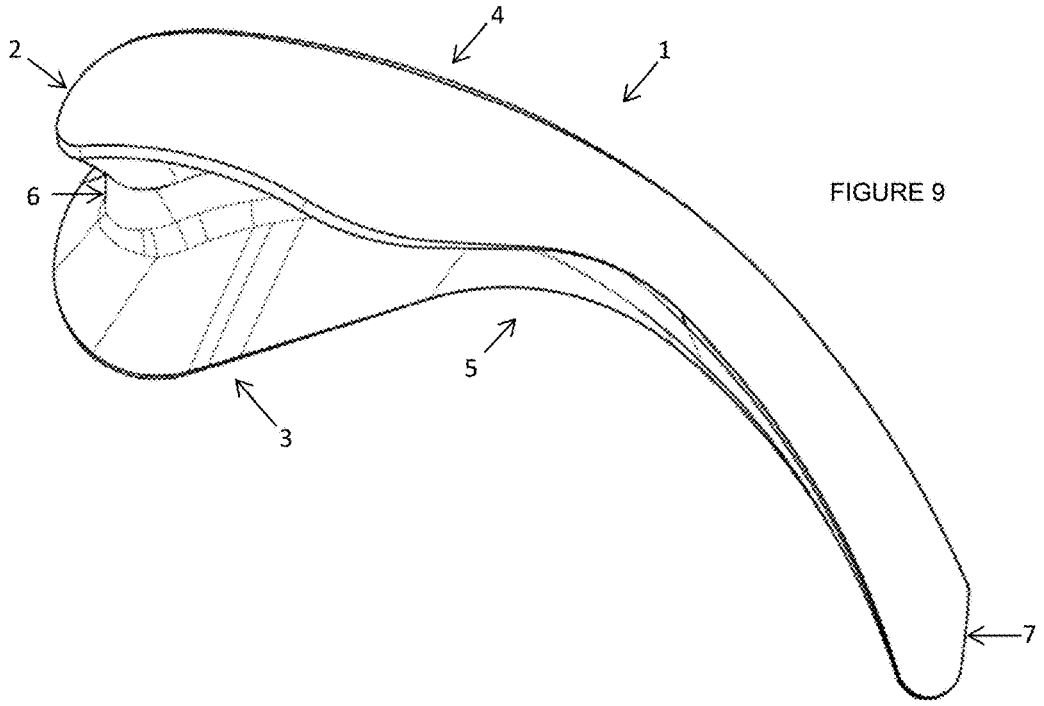
FIG. 9 shows a top view of an exemplary non-limiting vane (1) design from the inventive impeller device according to the embodiment shown in FIGS. 2, 4, 6, and 8.

FIG. 9 shows a top view of a vane (1) according to an embodiment of the invention having similarities with the embodiment shown in FIGS. 2, 4, 6, and 8.

Figure 10:
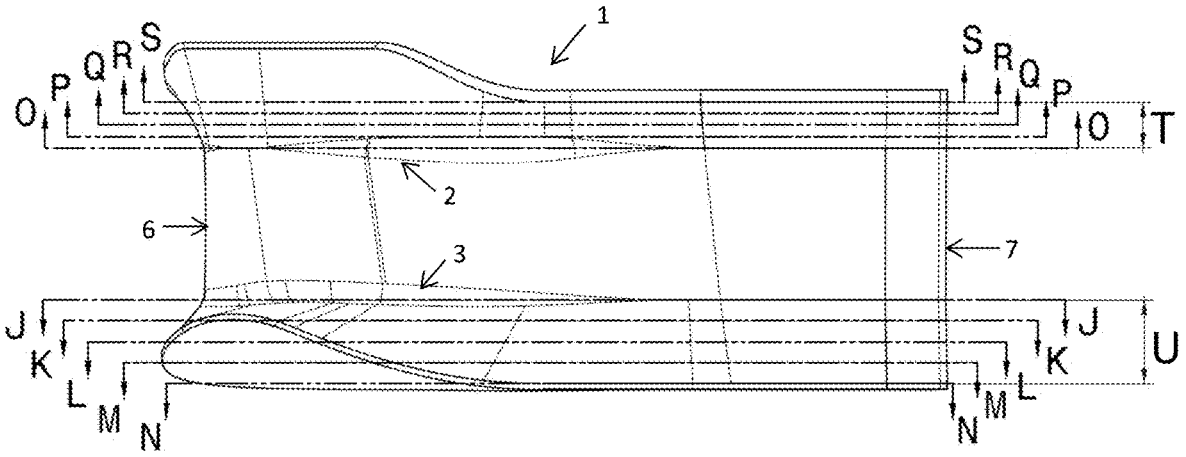
FIG. 10 shows a side view of the exemplary non-limiting vane (1) design shown in FIG. 10, further comprising various cross-sectional lines therethrough.
Figure 11:
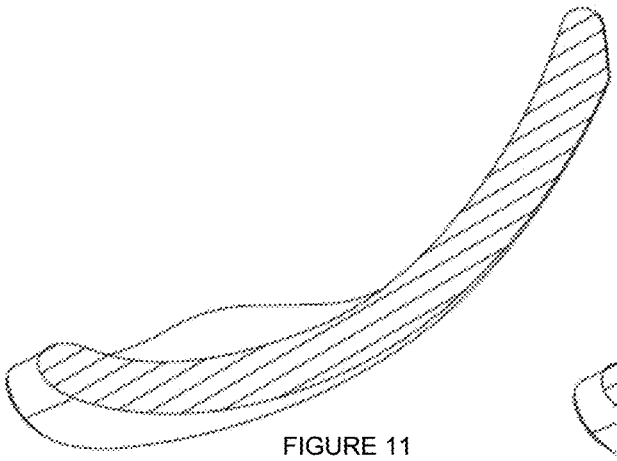
FIG. 11 shows a cross-sectional view of a vane (1) as seen from section line O-O shown in FIG. 10.
Figure 12:
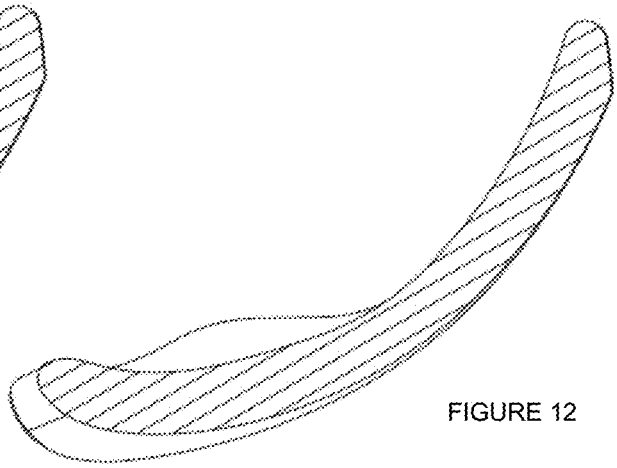
FIG. 12 shows a cross-sectional view of a vane (1) as seen from section line P-P shown in FIG. 10.
Figure 13:
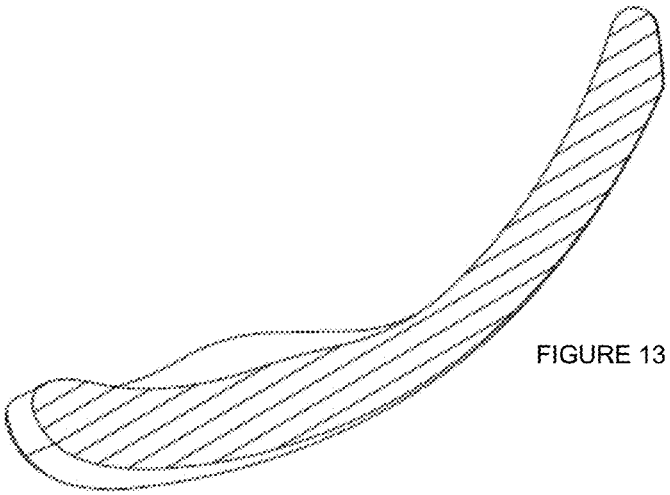
FIG. 13 shows a cross-sectional view of a vane (1) as seen from section line Q-Q shown in FIG. 10.
Figure 14:
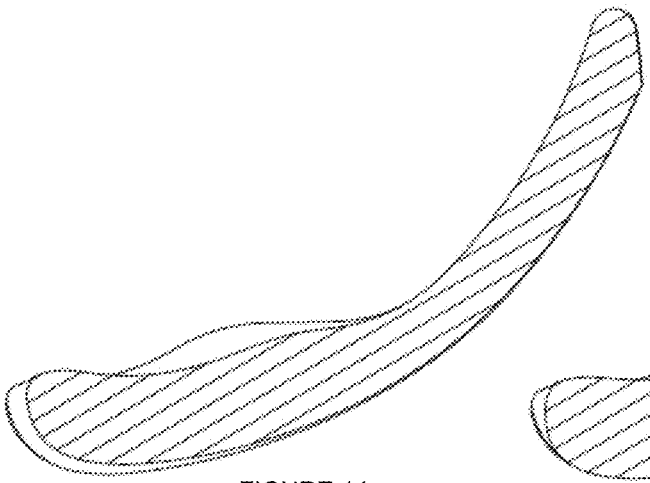
FIG. 14 shows a cross-sectional view of a vane (1) as seen from section line R-R shown in FIG. 10.
Figure 15:
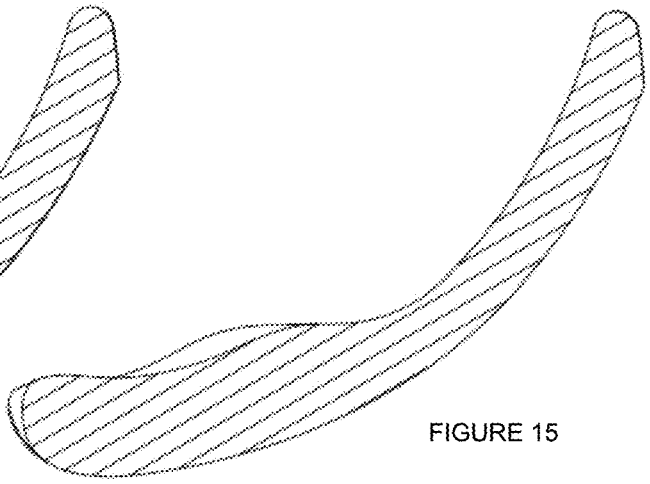
FIG. 15 shows a cross-sectional view of a vane (1) as seen from section line S-S shown in FIG. 10.
Figure 16:
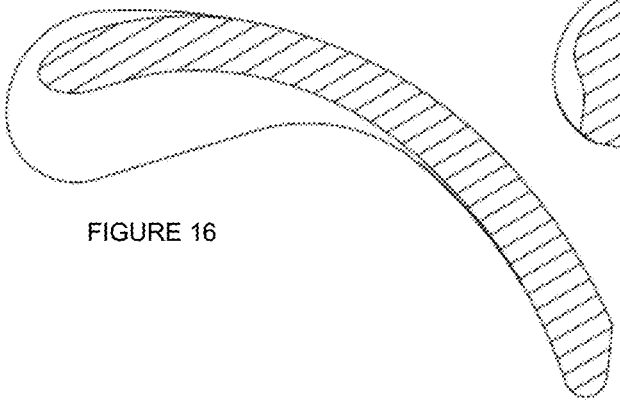
FIG. 16 shows a cross-sectional view of a vane (1) as seen from section line J-J shown in FIG. 10.
Figure 17:
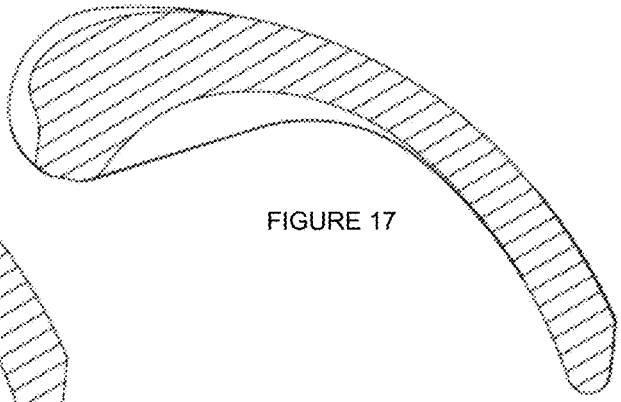
FIG. 17 shows a cross-sectional view of a vane (1) as seen from section line K-K shown in FIG. 10.
Figure 18:
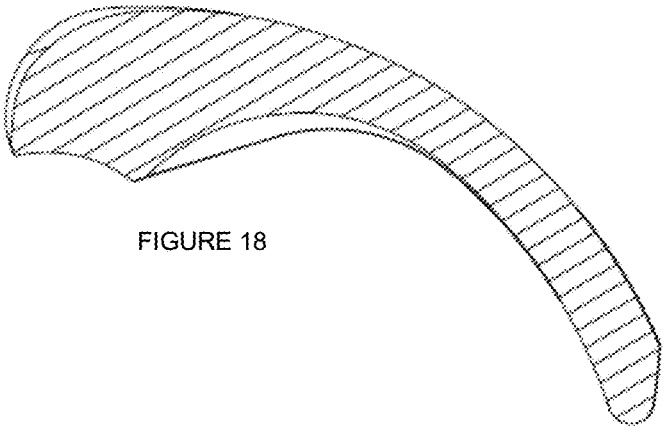
FIG. 18 shows a cross-sectional view of a vane (1) as seen from section line L-L shown in FIG. 10.
Figure 19:
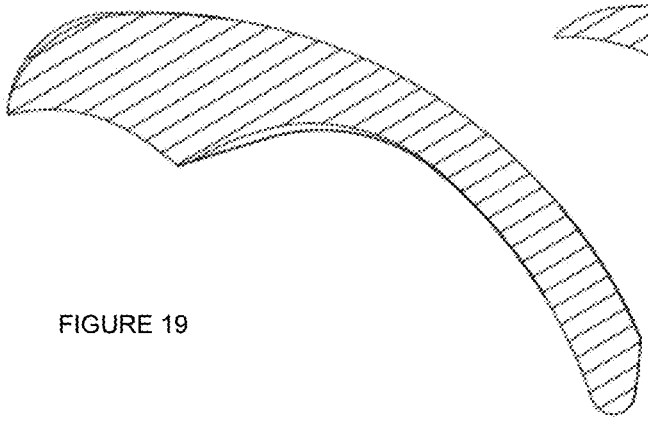
FIG. 19 shows a cross-sectional view of a vane (1) as seen from section line M-M shown in FIG. 10.
Figure 20:
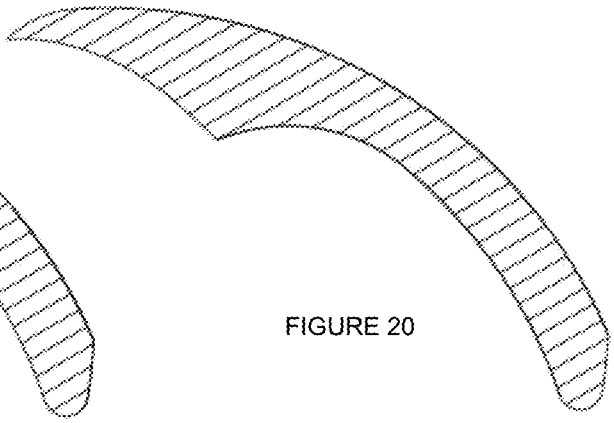
FIG. 20 shows a cross-sectional view of a vane (1) as seen from section line N-N shown in FIG. 10.

FIG. 10 suggests a side view of the vane (1) shown in FIG. 9 with various cross-sectional view lines superimposed thereon. In some non-limiting embodiment, the distance T between cross-sectional view O-O and cross-sectional view S-S may be less than a distance U between cross-sectional view J-J and cross-sectional view N-N. For example, distance T may be between approximately ¼ and ¾ times the distance U, without limitation. In the particular embodiment shown, distance T is approximately 6/11 times U (or just greater than half of the distance U).

Cross-sections O-O, P-P, Q-Q, R-R, and S-S represent a front side blending (2) adjacent to a front side shroud (15) and are shown in FIGS. 11-15, respectively. Cross-sections J-J, K-K, L-L, M-M, and N-N represent a rear side blending (3) adjacent a rear side shroud (16) and are shown in FIGS. 16-20, respectively.

It should be appreciated that the added material provided in the blendings discussed herein are not intended to serve purely as additional erosion material. Rather, the blendings are geometrically configured to modify flows to substantially reduce wear from abrasive slurry during use. It will be appreciated from computational fluid dynamics and ordinary artisans in the pump industry, that merely adding "more material" to the vanes or "thickening the vanes" to accommodate aggressive wear rates would not achieve the same results which may be achieved by the Applicant's design. Rather, the particular prescribed geometrical features actually modify flows, and improve hydraulics/hydrodynamics, so as to prevent "hot spots" where wear might be accelerated or failure may happen prematurely.

The geometrical descriptions presented above and illustrated in the appended drawings are provided merely as exemplary embodiments and practical modes of providing an improved impeller having one or more low vorticity vanes (1). These are just some of the embodiments of the present invention, and it should be understood that the present invention may be embodied or practiced in other specific forms without departing from its spirit or essential characteristics. For example, where the term "radius", "fillet", or "transition" is used herein, including in the claims, it is envisaged that a straight or planar (inside) chamfer may be employed as a substantial equivalent, simple alternative, or substitute to the curved (r) shown, without limitation. Accordingly, it is within the scope of this invention for terms like "chamfered," "faceted," "angled," "oblique," or "planar" transition to be interchanged with, or be deemed as being synonymous with terms such as "radiused", "filleted", or "rounded" transition, without limitation.

Moreover, while the preferred blending embodiments shown utilize a series of compound curves, arcs, convex surfaces, and concave surfaces in two and/or three dimensions, similar bulbous geometries may be approximated or generalized and equally employed, without limitation. Such approximated or generalized bulbous geometries may, for instance, utilize or incorporate facets, steps, or planar angled surfaces in any number or combination, with or without having smooth or rounded transitions therebetween. The described and claimed blending(s) may be precise and complex, or they may be crude and non-complex. The described and claimed blending(s) may be smooth, rough, or even jagged, without limitation. For example, rapid prototyping, machining, or mold tolerances may dictate the actual precision of the blendings. The exact sizes and/or shapes of the claimed blending(s) may differ slightly from what is precisely shown in the drawings, without departing from the spirit and scope of these inventive teachings. Moreover, alternative embodiments may comprise blendings which are of greater or smaller scale than what is shown. Blendings shown in the exemplary figures may be approximated and are not to scale. Proportions and dimensions may change according to the tables shown in FIGS. 21 and 22.

The inventor has determined that a front side blending (2) (provided alone to a vane (1)) has been shown to exhibit greater performance benefits than the rear side blending (3) (when provided alone to a vane (1)). However, the synergistic use of a rear side blending (3), in combination with a front side blending (2) appears to exhibit the greatest performance benefits.

The described embodiments are to be considered in all respects only as illustrative and not restrictive. The scope of the invention is, therefore, indicated and governed only by the appended claims, rather than by the foregoing description. All embodiments which come within the meaning and range of equivalency of the claims are to be embraced within their scope.

REFERENCE NUMERAL IDENTIFIERS

1, Vane
2. Front side blending
3. Rear side blending
4. Convex side
5. Concave side
6. Leading edge
7. Trailing edge
8. Conventional radius fillet
9. Rear side conventional radius fillet
10. Front side conventional radius fillet
11. Y-direction
12. X-direction
13. Z-direction
14. Suction inlet orifice
15. Front side shroud
16. Rear side shroud
17. Optional front and rear side blending envelopes

The invention claimed is:

1. An impeller for a centrifugal pump comprising: a vane (1) extending in a Z-direction between a front side shroud (15) which is annular in shape and defines a suction inlet orifice (14), and a rear side shroud (16); the vane (1) comprising:

a radially inward leading edge (6), a radially outward trailing edge (7), a convex side (4), and a concave side (5), the vane (1) further being connected to the front side shroud (15) and to the rear side shroud (16), the impeller further comprising a front side blending (2) being provided proximate a central region of the impeller and adjacent to the front side shroud (15) between a surface of the vane (1) and a surface of the front side shroud (15); the front side blending (2) extending from a first point (s1) on the convex side (4) of the vane (1), circumferentially along the vane's perimeter, and peripherally around the leading edge (6) of the vane (1), to a second point (s6) on the concave side (5) of the vane (1) along the vane's perimeter;

the front side blending (2) being provided proximate to and extending from the leading edge (6) of the vane (1); the geometry of the front side blending (2) being adapted to optimize flow patterns adjacent the vane and between the respective front and rear side shrouds in a manner which discourages the formation of horseshoe vortices proximate the leading edge (6) of the vane (1) during operation; wherein by virtue of discouraging the formation of horseshoe vortices proximate the leading edge (6) of the vane (1) during operation, the front side blending (2) is adapted to resist wear to the vane (1) caused by abrasion during operation, thereby extending the life of the impeller;

wherein a width of the front side blending (2) increases from a first width (w4) of the front side blending (2) near the first point (s1) of the front side blending (2), to a larger fourth width (w7) of the front side blending (2) near the second point (s6) of the front side blending (2) as the front side blending (2) progresses circumferentially along the vane's perimeter and peripherally around the leading edge (6) from the first point (s1) of the front side blending (2) to the second point (s6) of the front side blending (2);

wherein the front side blending (2) further comprises a transitional second width (w5) between the first width (w4) of the front side blending (2) and the fourth width (w7) of the front side blending (2) at a point along the vane's perimeter which is circumferentially disposed between the first point (s1) of the front side blending (2) and the second point (s6) of the front side blending (2);

wherein the leading edge (6) is encompassed between the first point (s1) of the front side blending (2) and the second point (s6) of the front side blending (2) when viewed along said Z-direction in an X-Y plane which is perpendicular to said Z-direction; and wherein the transitional second width (w5) of the front side blending (2) is equal to or larger than the first width (w4) and smaller than the fourth width (w7).

2. The impeller according to claim 1, further comprising a rear side blending (3) provided to the vane (1); the rear side blending (3) being provided proximate the central region of the impeller and adjacent to the rear side shroud (16) between a surface of the vane (1) and a surface of the rear side shroud (16); the rear side blending (3) extending from a first point (p1) on the convex side (4) of the vane (1), circumferentially along the vane's perimeter, and peripherally around the leading edge (6) of the vane (1), to a second point (p4) on the concave side (5) of the vane (1) along the vane's perimeter;

the rear side blending (3) being provided proximate to and extending from the leading edge (6) of the vane (1); the geometry of the rear side blending (3) being adapted to optimize flow patterns adjacent the vane and between the respective front and rear side shrouds in a manner which discourages the formation of horseshoe vortices proximate the leading edge (6) of the vane (1) during operation; wherein by virtue of discouraging the formation of horseshoe vortices proximate the leading edge (6) of the vane (1) during operation, the rear side blending (3) is adapted to resist wear to the vane (1) caused by abrasion during operation, thereby extending the life of the impeller.

3. The impeller according to claim 2, wherein the front side blending (2) geometrically differs from the rear side blending (3).

4. The impeller according to claim 2, wherein the rear side blending (3) transitions to a rear side uniform radius fillet (9) at the first point (p1) and at the second point (p4) on the rear side blending (3) where portions of the rear side blending (3) terminate; the rear side uniform radius fillet (9) being provided between a surface of the vane and a surface of the rear side shroud (16).

5. The impeller according to claim 4, wherein the rear side blending (3) geometrically differs from the front side blending (2) and the rear side uniform radius fillet (9).

6. The impeller according to claim 4, wherein the rear side uniform radius fillet (9) extends from the first point (p1) on the convex side (4) of the vane (1), circumferentially along the vane's perimeter to the second point (p4) on the concave side (5) of the vane (1); wherein the rear side uniform radius fillet (9) extends peripherally around the trailing edge (7) of the vane (1) along the rear side shroud (16); and wherein the rear side blending (3) initially grows in width (w1) beyond the first point (p1) of the rear side blending (3), then subsequently grows further in width (w2), and then subsequently grows to its largest width (w3), before finally returning to the second point (p4) of the rear side blending (3); the rear side uniform radius fillet (9) joining back up with the rear side blending (3) at the second point (p4) of the rear side blending (3).

7. The impeller according to claim 1, wherein the front side blending (2) decreases from the first width (w4) near the first point (s1) of the front side blending (2) on the convex side (4) of the vane (1), to a transitional third width (w6), before widening to the fourth width (w7) near the second point (s6) of the front side blending (2) on the concave side (5) of the vane (1).

8. The impeller according to claim 1, wherein the front side blending (2) comprises four inflection points (s2, s3, s4, s5) provided between the first point (s1) of the front side blending (2) and the second point (s6) of the front side blending (2) along the vane's perimeter;

wherein the four inflection points (s2, s3, s4, s5) comprise a first inflection point (s2), a second inflection point (s3), a third inflection point (s4), and a fourth inflection point (s5).

9. The impeller according to claim 8, wherein the first inflection point (s2) of the front side blending (2) lies between the first point (s1) of the front side blending (2) and the second inflection point (s3) of the front side blending (2); wherein the second inflection point (s3) of the front side blending (2) lies between the first inflection point (s2) of the front side blending (2) and the third inflection point (s4) of the front side blending (2); wherein the third inflection point (s4) of the front side blending (2) lies between the second inflection point (s3) of the front side blending (2) and the fourth inflection point (s5) of the front side blending (2); and wherein the fourth inflection point (s5) of the front side blending (2) lies between the third inflection point (s4) of the front side blending (2) and the second point (s6) of the front side blending (2); wherein a portion of the front side blending (2) extending between the first point (s1) of the front side blending (2) and the first inflection point (s2) of the front side blending (2) is concave; wherein a portion of the front side blending (2) extending between the first inflection point (s2) of the front side blending (2) and the second inflection point (s3) of the front side blending (2) is convex; wherein a portion of the front side blending (2) extending between the second inflection point (s3) of the front side blending (2) and the third inflection point (s4) of the front side blending (2) is concave; wherein a portion of the front side blending (2) extending between the third inflection point (s4) of the front side blending (2) and the fourth inflection point (s5) of the front side blending (2) is convex; and wherein a portion of the front side blending (2) extending between the fourth inflection point (s5) of the front side blending (2) and the second point (s6) of the front side blending (2) is concave.

10. The impeller according to claim 1, wherein the second point (s6) of the front side blending (2) is located closer to the trailing edge (7) of the vane (1) than the first point (s1) of the front side blending (2).

11. The impeller according to claim 10, wherein the second point (s6) of the front side blending (2) is located closer to the trailing edge (7) of the vane (1) than the first point (s1) of the front side blending (2) in at least a Y-direction (11), wherein the Y-direction (11) is perpendicular to the Z-direction (13) and an X-direction (12).

12. The impeller according to claim 10, wherein the second point (s6) of the front side blending (2) is located closer to the trailing edge (7) of the vane (1) than the first point (s1) of the front side blending (2) in at least an X-direction (12), wherein the X-direction (12) is perpendicular to the Z-direction (13) and a Y-direction (11).

13. The impeller according to claim 2, wherein the rear side blending (3) comprises two inflection points (p2, p3) provided between the first point (p1) of the rear side blending (3) and the second point (p4) of the rear side blending (3) along the vane's perimeter; the two inflection points (p2, p3) which include:

a first inflection point (p2) between the first point (p1) of the rear side blending (3) and the second point (p4) of the rear side blending (3), and a second inflection point (p3) between the first point (p1) of the rear side blending (3) and the second point (p4) of the rear side blending (3).

14. The impeller according to claim 13, wherein the first inflection point (p2) of the rear side blending (3) lies between the first point (p1) of the rear side blending (3) and the second inflection point (p3) of the rear side blending (3); wherein the second inflection point (p3) of the rear side blending (3) lies between the first inflection point (p2) of the rear side blending (3) and the second point (p4) of the rear side blending (3); wherein a portion of the rear side blending (3) extending between the first point (p1) of the rear side blending (3) and the first inflection point (p2) of the rear side blending (3) is concave; wherein a portion of the rear side blending (3) extending between the first inflection point (p2) of the rear side blending (3) and the second inflection point (p3) of the rear side blending (3) is convex; and wherein a portion of the rear side blending (3) extending between the second inflection point (p3) of the rear side blending (3) and the second point (p4) of the rear side blending (3) is concave.

15. A method comprising:

providing the impeller according to claim 1 to the centrifugal pump of claim 1;

running slurry through the centrifugal pump while the impeller is turning; and, discouraging the formation of horseshoe vortices thereby reducing wear to the impeller during operation of the centrifugal pump by virtue of vane (1) design characteristics of the impeller.

16. An impeller for a centrifugal pump comprising: a vane (1) extending in a Z-direction between a front side shroud (15) which is annular in shape and defines a suction inlet orifice (14), and a rear side shroud (16); the vane (1) comprising a radially inward leading edge (6), a radially outward trailing edge (7), a convex side (4), and a concave side (5), the vane (1) further being connected to the front side shroud (15) and to the rear side shroud (16), the impeller further comprising a front side blending (2) and a rear side blending (3); the front side blending (2) being provided proximate a central region of the impeller and adjacent to the front side shroud (15) between a surface of the vane (1) and a surface of the front side shroud (15); the front side blending (2) extending from a first point (s1) on the convex side (4) of the vane (1), circumferentially along the vane's perimeter, and peripherally around the leading edge (6) of the vane (1), to a second point (s6) on the concave side (5) of the vane (1) along the vane's perimeter; the rear side blending (3) being provided proximate the central region of the impeller and adjacent to the rear side shroud (16) between a surface of the vane (1) and a surface of the rear side shroud (16); the rear side blending (3) extending from a first point (p1) on the convex side (4) of the vane (1), circumferentially along the vane's perimeter, and peripherally around the leading edge (6) of the vane (1), to a second point (p4) on the concave side (5) of the vane (1) along the vane's perimeter; each of the front side blending (2) and rear side blending (3) being provided proximate to and extending from the leading edge (6) of the vane (1); wherein each of the front side blending (2) and rear side blending (3) are configured with a geometry which geometrically differs from a uniform radius fillet (8), the geometry of each of the front side blending (2) and the rear side blending (3) discouraging the formation of horseshoe vortices proximate the leading edge (6) of the vane (1) during operation; wherein by virtue of discouraging the formation of horseshoe vortices proximate the leading edge (6) of the vane (1) during operation, each of the front side blending (2) and the rear side blending (3) are adapted to resist wear to the vane (1) caused by abrasion during operation, thereby extending the life of the impeller; wherein a width of the rear side blending (3) increases from a first width (w1) near the first point (p1) of the rear side blending (3), to a larger third width (w3) near the second point (p4) of the rear side blending (3), as the rear side blending (3) progresses circumferentially along the vane's perimeter and peripherally around the leading edge (6) from the first point (p1) of the rear side blending (3) to the second point (p4) of the rear side blending (3); and wherein the rear side blending (3) further comprises a transitional second width (w2) between the first width (w1) and the third width (w3) at a point along the vane's perimeter which is circumferentially disposed between the first point (p1) of the rear side blending (3) and the second point (p4) of the rear side blending (3); wherein the leading edge (6) is encompassed between the first point (p1) of the rear side blending (3) and the second point (p4) of the rear side blending (3) when viewed along said Z-direction in a plane which is perpendicular to said Z-direction; wherein the transitional second width (w2) of the rear side blending (3) is larger than the first width (w1) and smaller than the third width (w3).

17. An impeller for a centrifugal pump comprising: a vane (1) extending in a Z-direction between a front side shroud (15) which is annular in shape and defines a suction inlet orifice (14), and a rear side shroud (16); the vane (1) comprising a radially inward leading edge (6), a radially outward trailing edge (7), a convex side (4), and a concave side (5), the vane (1) further being connected to the front side shroud (15) and to the rear side shroud (16), the impeller further comprising at least one of a front side blending (2) and a rear side blending (3); the front side blending (2) being provided proximate a central region of the impeller and adjacent to the front side shroud (15) between a surface of the vane (1) and a surface of the front side shroud (15); the front side blending (2) extending from a first point (s1) on the convex side (4) of the vane (1), circumferentially along the vane's perimeter, and peripherally around the leading edge (6) of the vane (1), to a second point (s6) on the concave side (5) of the vane (1) along the vane's perimeter; the rear side blending (3) being provided proximate the central region of the impeller and adjacent to the rear side shroud (16) between a surface of the vane (1) and a surface of the rear side shroud (16); the rear side blending (3) extending from a first point (p1) on the convex side (4) of the vane (1), circumferentially along the vane's perimeter, and peripherally around the leading edge (6) of the vane (1), to a second point (p4) on the concave side (5) of the vane (1) along the vane's perimeter; each of the front side blending (2) and rear side blending (3) being provided proximate to and extending from the leading edge (6) of the vane (1); the geometry of each of the front side blending (2) and the rear side blending (3) being adapted to optimize flow patterns adjacent the vane and between the respective front and rear side shrouds in a manner which discourages the formation of horseshoe vortices proximate the leading edge (6) of the vane (1) during operation; wherein by virtue of discouraging the formation of horseshoe vortices proximate the leading edge (6) of the vane (1) during operation, each of the front side blending (2) and the rear side blending (3) are adapted to resist wear to the vane (1) caused by abrasion during operation, thereby extending the life of the impeller;

wherein the front side blending (2) transitions to a front side uniform radius fillet (10) at the first point (s1) and at the second point (s6) on the front side blending (2) where portions of the front side blending (2) terminate, the front side uniform radius fillet (10) being provided between a surface of the vane and a surface of the front side shroud (15); and wherein the rear side blending (3) transitions to a rear side uniform radius fillet (9) at the first point (p1) and at the second point (p4) on the rear side blending (3) where portions of the rear side blending (3) terminate; the rear side uniform radius fillet (9) being provided between a surface of the vane and a surface of the rear side shroud (16);

wherein the rear side blending transitions to the rear side uniform radius fillet (9) at an angle (B1), at the second point (p4) of the rear side blending; the angle (B1) being measured about an axis defining the Z-direction, between the leading edge of the vane and the second point (p4) of the rear side blending; and wherein the front side blending transitions to the front side uniform radius fillet (10) at an angle (B2), at the second point (s6) of the front side blending; the angle (B2) being measured about the axis defining the Z-direction, between the leading edge of the vane and the second point (s6) of the front side blending, and wherein the angle (B2) is greater than the angle (B1).

18. The impeller according to claim 17, wherein the second point (p4) of the rear side blending (3) is located closer to the trailing edge (7) of the vane (1) than the first point (p1) of the rear side blending (3).

19. The impeller according to claim 18, wherein the second point (p4) of the rear side blending (3) is located closer to the trailing edge (7) of the vane (1) than the first point (p1) of the rear side blending (3) in at least a Y-direction (11), which is perpendicular to the Z-direction (13) and an X-direction (12).

20. The impeller according to claim 18, wherein the second point (p4) of the rear side blending (3) is located closer to the trailing edge (7) of the vane (1) than the first point (p1) of the rear side blending (3) in at least an X-direction (12), which is perpendicular to the Z-direction (13) and a Y-direction (11).

* * * * *